US008180266B2

(12) United States Patent
Kerxhalli et al.

(10) Patent No.: US 8,180,266 B2
(45) Date of Patent: May 15, 2012

(54) METHOD, APPARATUS AND SYSTEMS FOR REGISTERING THE TRANSFER OF AN IMAGE ASSOCIATED WITH A PRINTING DEVICE

(75) Inventors: David Mark Kerxhalli, Rochester, NY (US); Siddharth Rajiv Inamdar, Rochester, NY (US); Paul Eugene Musicant, Los Angeles, CA (US)

(73) Assignee: Xerox Corporation, Norwalk, CT (US)

( * ) Notice: Subject to any disclaimer, the term of this patent is extended or adjusted under 35 U.S.C. 154(b) by 381 days.

(21) Appl. No.: 12/477,524

(22) Filed: Jun. 3, 2009

(65) Prior Publication Data

US 2010/0310282 A1 Dec. 9, 2010

(51) Int. Cl.
*G03G 15/01* (2006.01)

(52) U.S. Cl. ..... 399/301; 399/302

(58) Field of Classification Search ..... 399/301, 399/302; 347/116

See application file for complete search history.

(56) References Cited

U.S. PATENT DOCUMENTS 5,208,796 A 5/1993 Wong et al.
5,291,245 A * 3/1994 Charnitski et al. ..... 399/51
5,376,999 A 12/1994 Hwang
5,510,877 A 4/1996 deJong et al.
5,697,030 A 12/1997 Hayashi et al.
6,055,398 A 4/2000 Costanza et al.
6,300,968 B1 * 10/2001 Kerxhalli et al. ..... 347/116
6,909,516 B1 6/2005 Hoover
6,911,993 B2 * 6/2005 Nishikawa et al. ..... 347/116
6,934,497 B2 8/2005 Hagiwara et al.
7,039,348 B2 * 5/2006 Kerxhalli et al. ..... 399/301
7,177,571 B2 2/2007 Sato et al.
7,258,414 B2 * 8/2007 Satoh ..... 347/19
7,298,998 B1 11/2007 Tooker et al.
7,424,255 B2 * 9/2008 Sakai ..... 399/301
7,542,058 B2 * 6/2009 Nishikawa et al. ..... 347/116
7,671,877 B2 * 3/2010 Fitzpatrick et al. ..... 347/116
7,812,735 B2 * 10/2010 Kahl et al. ..... 340/676
2004/0202489 A1 * 10/2004 Kudou et al. ..... 399/66
2006/0133861 A1 * 6/2006 Sakai ..... 399/301
2007/0175351 A1 * 8/2007 Boness ..... 101/485
2008/0124158 A1 5/2008 Folkins
2009/0148185 A1 * 6/2009 Kudo et al. ..... 399/167

* cited by examiner

*Primary Examiner* — David Gray
*Assistant Examiner* — G.M. Hyder
(74) *Attorney, Agent, or Firm* — Fay Sharpe LLP

(57) ABSTRACT

This disclosure provides a method, apparatus, and system for registering the transfer of an image from a belt to a media substrate associated with a printing device. Specifically, the exemplary methods use a ROS master clock and belt location sensor located downstream of a belt tensioning device to generate a reg sync signal to initiate transfer of the image.

21 Claims, 4 Drawing Sheets

METHOD, APPARATUS AND SYSTEMS FOR REGISTERING THE TRANSFER OF AN IMAGE ASSOCIATED WITH A PRINTING DEVICE

BACKGROUND

This disclosure relates to registration of images in printing systems. It finds particular application in connection with a registration system for a multicolor printing system which compensates for belt stretch associated with an intermediate image transfer belt.

To provide accurate printing of images, multicolor digital marking systems need to maintain adequate color to color registration. In systems that utilize an elongate image receiving surface, such as a paper web or a belt, the receiving surface reaches a first marking station where a marking material of a first color is applied to the surface, e.g., by firing ink jets, exposing an image on a photoconductive material, or applying toner particles to a selectively imaged photoconductive member. The receiving surface then moves on to a second marking station, where an image or marking material of a second color is applied, and so forth, depending on the number of colors. The timing of the actuation of the second marking station is controlled as a function of the speed of the image receiving surface so that the images applied by the two marking stations are registered one on top of the other to form a composite, multicolor image. A high degree of process direction alignment can be achieved by implementing what is generally known as reflex printing, where the speed or position of the image receiving surface is measured with an encoder at a certain location and then the images are timed accordingly. For example, an encoder is associated with a drive nip roller. The rotational speed of the roller is used to calculate the speed of the image receiving surface passing through the nip. The time for actuating the first, second, and subsequent marking stations is then calculated, based on their respective distances from the drive nip roller and the determined speed of the image receiving surface.

In the case of an electrophotographic printer, an encoder may be placed on the photoreceptor belt to measure the exact speed of the belt at each instant of time. The timing from this signal can then be used to time the firing of the laser raster output scanner (ROS) or light emitting diode (LED) bar so that an even spacing of lines is imaged on the photoreceptor, thus compensating for any variability in the photoreceptor speed from a set speed. In a multicolor system, the timing from the encoder can also be used to determine the exact time to fire successive color images to obtain good color on color registration, again compensating for any photoreceptor speed variations.

An implicit assumption of such reflex printing systems is that the belt or web is infinitely stiff (i.e., it does not stretch or change length) such that the encoder measurement of the web or belt velocity enables an exact prediction of correct registration. In situations where the belt or web exhibits any sizeable amount of stretch or deformation, reflex printing techniques may still be subject to misregistration errors.

INCORPORATION BY REFERENCE

U.S. Publication No. 2008/0124158, on published May 29, 2008, entitled "DOUBLE REFLEX PRINTING," by Jeffrey Folkins, is incorporated herein by reference in its entirety.

U.S. Pat. No. 7,298,998, issued on Nov. 20, 2007 entitled "IMAGE REGISTRATION CONTROL UTILIZING REAL TIME IMAGE SYNCHRONIZATION," by Ana Tooker, et al., is incorporated herein by reference in its entirety.

BRIEF DESCRIPTION

In one aspect of this disclosure, a method of registering a transfer of an image from a belt to a media substrate associated with a printing device is disclosed wherein the printing device includes an image transfer belt operatively coupled to one or more primary image transfer devices configured to transfer an image to the image transfer belt, an image transfer point configured to transfer an image from the image transfer belt to the media substrate, an image transfer belt location target fixed to the image transfer belt, a first belt location sensor operatively connected to a controller for timing the transfer of images from the primary image transfer devices to the image transfer belt, a second belt location located downstream of the belt tensioning device and upstream of the image transfer point, the second belt location sensor operatively connected to the controller for timing the transfer of an image from the image transfer belt to the media substrate at the image transfer point, and a master clock operatively connected to the controller for timing the transfer of an image to the image transfer belt and the transfer of an image from the image transfer belt to the media substrate, the method comprising: a) detecting the presence of the belt location target by the first belt location sensor; b) transferring an image to the image transfer belt from one or more of the primary image transfer devices after a first predetermined number of master clock counts; c) detecting the presence of the belt location target by the second belt location sensor; and d) transferring the image from the image transfer belt to a media substrate after a second predetermined number of master clock counts whereby the second predetermined number of master clock counts corresponds to the time required for the image transfer belt to travel the distance from the second belt location sensor to the image transfer point.

In another aspect of this disclosure, disclosed is a computer program product, storing instructions that when executed by a computer, cause the computer to perform a method of registering a transfer of an image from a belt to a media substrate associated with a printing device, the printing device including an image transfer belt operatively coupled to one or more primary image transfer devices configured to transfer an image to the image transfer belt, an image transfer point configured to transfer an image from the image transfer belt to the media substrate, an image transfer belt location target fixed to the image transfer belt, a first belt location sensor operatively connected to a controller for timing the transfer of images from the primary image transfer devices to the image transfer belt, a second belt location located downstream of the belt tensioning device and upstream of the image transfer point, the second belt location sensor operatively connected to the controller for timing the transfer of an image from the image transfer belt to the media substrate at the image transfer point, and a master clock operatively connected to the controller for timing the transfer of an image to the image transfer belt and the transfer of an image from the image transfer belt to the media substrate, the method comprising: a) detecting the presence of the belt location target by the first belt location sensor; b) transferring an image to the image transfer belt from one or more of the primary image transfer devices after a first predetermined number of master clock counts; c) detecting the presence of the belt location target by the second belt location sensor; and d) transferring the image from the image transfer belt to a media substrate after a second predetermined number of master clock counts whereby the second predetermined number of master clock counts corresponds to the time required for the image transfer belt to travel the distance from the second belt location sensor to the image transfer point.

In still another aspect of this disclosure, a printing apparatus comprising an image transfer belt including a belt tensioning device is disclosed with one or more primary image transfer devices configured to transfer an image to the image transfer belt; an image transfer point adapted to transfer an image from the image transfer belt to a media substrate; a target fixed to the image transfer belt to determine the location of the image transfer belt; a first belt location sensor located upstream of the one or more primary image transfer devices; a second belt location sensor located downstream of the belt tensioning device and upstream of the image transfer point; a master clock; and a controller, the controller configured to execute the method comprising: a) detecting the presence of the belt location target by the first belt location sensor; b) transferring an image to the image transfer belt from one or more of the primary image transfer devices after a first predetermined number of master clock counts; c) detecting the presence of the belt location target by the second belt location sensor; and d) transferring the image from the image transfer belt to a media substrate after a second predetermined number of master clock counts whereby the second predetermined number of master clock counts corresponds to the time required for the image transfer belt to travel the distance from the second belt location sensor to the image transfer point.

DETAILED DESCRIPTION

This disclosure relates to registration of images in printing systems. It finds particular application in connection with a registration system for a multicolor printing system which compensates for belt stretch associated with an intermediate image transfer belt.

Figure 1:
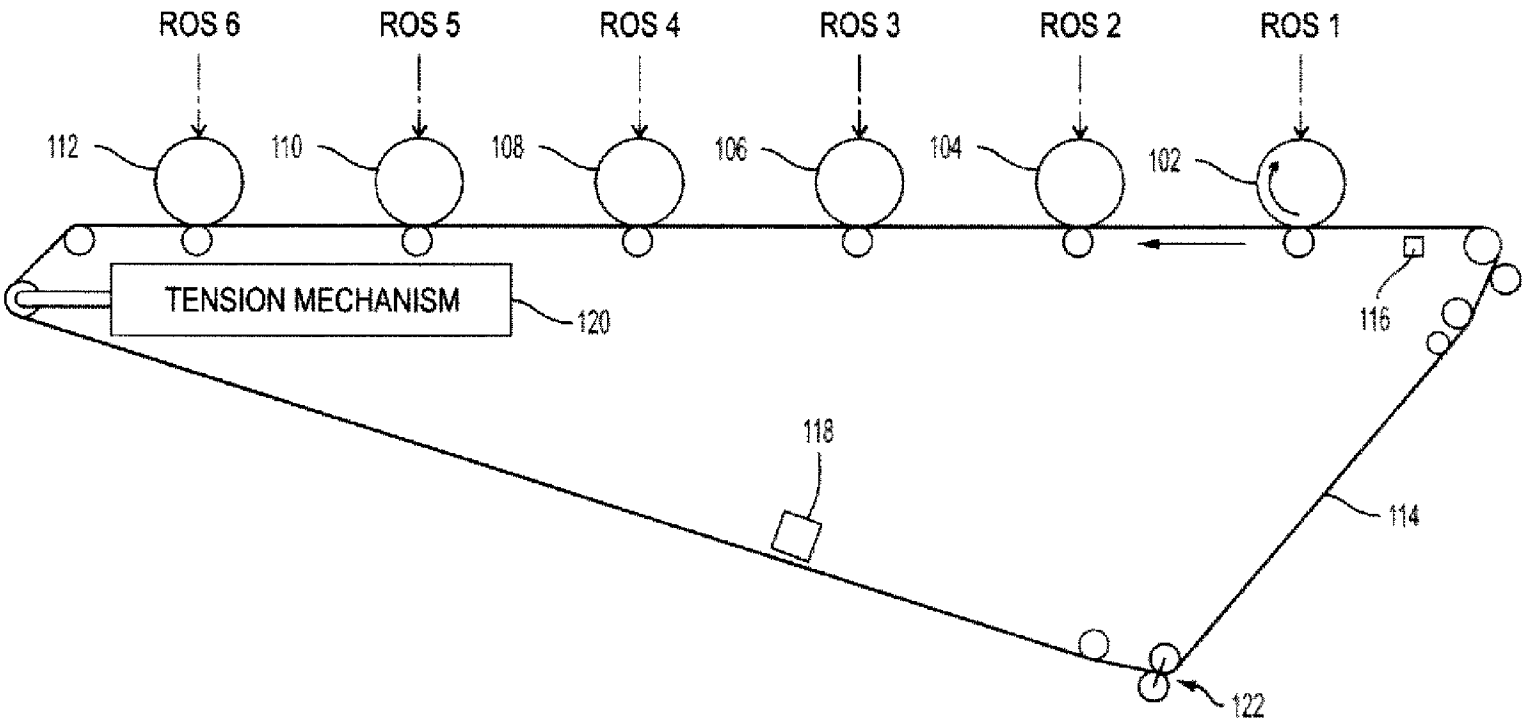
FIG. 1 is a schematic of a printing apparatus according to an exemplary embodiment of this disclosure.

Specifically, this disclosure provides methods, apparatus and systems to generate a paper reg sync signal when there is a belt tensioning mechanism located between the last ROS and transfer to paper. With reference to FIG. 1, two belt home sensors 116, 118 are used in the system, sensing the location of a fixed feature on the belt 114, such as a belt hole. The images are located around the belt 114 relative to a belt home sensor (BHS1) 116 that is located upstream of the imaging stations 102, 104, 106, 108, 110 and 112. When BHS1 116 detects the belt hole, a calculated number of clock transitions (blocks of 256 ROS master clocks) are counted before an image sync signal is sent to each ROS of the imaging stations 102, 104, 106, 108, 110 and 112 for each image of that particular belt revolution. An additional belt home sensor (BHS2) 118 is located close to transfer 122, downstream of the tension mechanism 120. When the belt hole arrives at BHS2 118 (belt home sensor #2 detects the belt position), the system will begin counting ROS master clocks in blocks of 256. This is exactly the same counter that is used to generate the image sync signal, which defines the location of the images on the IT Belt (intermediate transfer belt) relative to the seam. The system will generate a reg sync signal which coincides with the image panel LE as it passes by BHS2 118. This disclosure also outlines a "fine correction" for the reg sync signal which resolves the time delta between the BHS1 transition to the next ROS master clock block count and BHS2 transition to the next ROS master clock block count.

The reg sync signal is the signal in a print engine that is sent to the paper path indicating to the paper path the location of the image traveling on the belt or drum. In some systems, this signal is generated by the ROS interface module (RIM), transitioning low as the first scanline is written by the ROS. This method assumes that the time from when the signal is generated to transfer is constant. In other systems, it is known that this time will change. For instance, in some systems, such as FIG. 1, there is a belt tensioning mechanism placed between the last ROS and transfer to paper. Any stretch or shrink of the belt will then change the time from reg sync to transfer to paper.

Figure 2:
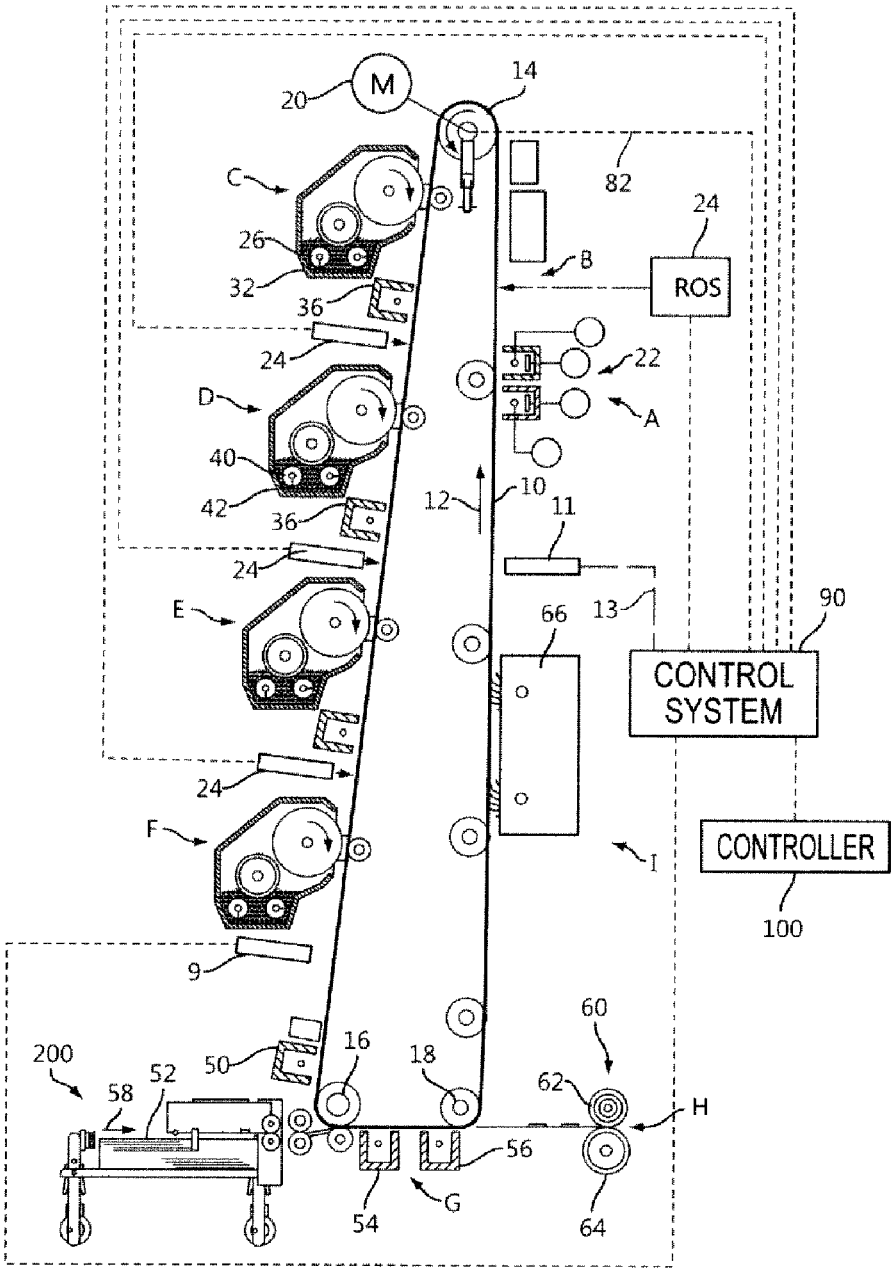
FIG. 2 is a schematic of another printing apparatus according to an exemplary embodiment of this disclosure.

As briefly discussed above, the reg sync signal indicates to the paper registration system (reg steering controller and pre-transfer controller) the time when a given image lead-edge will be at the point of transfer (this is called $2^{nd}$ transfer for intermediate belt technology). In this system, as illustrated in FIG. 2, the signal is generated from the Station 4 (the last color station in the process direction) ROS interface module. However, in other systems, this is not possible because the tension mechanism is between the last color station and $2^{nd}$ transfer (see FIG. 1). Therefore, as the intermediate transfer belt stretches over time, the time between the last color station and $2^{nd}$ transfer will change.

In order to accurately generate the reg sync signal with the architecture illustrated in FIG. 1, BHS2 118 will be used as the reference signal. This sensor is located between the tension mechanism 120 and $2^{nd}$ transfer 122. The FPGA (Field Programmable Gate Array) on the MIOP (Marker I/O Processor) receives this signal. When BHS2 118 detects the belt position, the system will begin counting ROS master clocks in blocks of 256. This is exactly the same counter that is used to generate the image sync signal, which defines the location of the images on the IT belt relative to the seam. The system will generate a reg sync signal which coincides with the image panel LE (leading edge) as it passes by BHS2 118.

The FPGA on the MIOP board is the source for generating both the image sync signal and the reg sync signal. The image sync signal is generated by counting ROS master clock blocks relative to BHS1 116. The reg sync signal is generated by counting ROS master clock blocks relative to BHS2 118. ROS master clock blocks consist of 256 ROS master clocks, which equates to approximately 85 microns on the IT belt. Because image sync and reg sync use different BHSs (which are not synchronous with the RMC blocks) as reference signals to begin counting RMC blocks, there is a random belt rev to belt rev error between image sync and reg sync of up to 85 microns. This can result in an IOP (Image on Paper) reg error (process margin) of the same magnitude because the paper reg system is timing the paper arrival at transfer to the reg sync signal, which has error relative to the location of the image on the IT belt. This error needs to be eliminated in order to achieve stringent IOP reg specs. In order to eliminate this error, the FPGA on the MIOP counts single ROS master clocks (which is 256 times faster than the clock used for image timing) from when it detects BHS1 until the next ROS master clock block, BHS1_To_RMCBlock. For the same belt rev, it also counts single ROS master clocks from BHS until the next RMC block, BHS2_To_RMCBlock. Then the difference between the single ROS master clock counts relative to each BHS is calculated (BHS1_To_RMCBlock–BHS2_To_RMCBlock), and this value is added into the calculations for reg sync.

The MIOP can use the seam hole trail edge received from the BHS2 118 as the reference point for the reg sync signal.

The MIOP can generate a digital reg sync signal for each image panel that corresponds to a sheet in the paper path.

The Apps SW can calculate the number of 256 ROS master clock blocks from the debounced trail edge of the seam hole signal at BHS2 118 to the LE of reg sync for image panel #1. This value can be downloaded to the FPGA on the MIOP. The value is calculated according to one exemplary embodiment as follows:

---

TESeamHoleDB_To_LEImagePanel1 = BeltTrailEdgeSeamHoleToLESeamZone + BeltSeamZoneLengthPitch − BeltVirtualSeamHoleOffsetLength + NVM_PEGImageShiftTotalmm
Where:
TESeamHoleDB_To_LEImagePanel1 = Distance along the IT Belt from the Trail Edge of the Seam Hole to the Lead Edge of Image Panel 1; Units = mm.
BeltTrailEdgeSeamHoleToLESeamZone = Distance along the IT Belt from the Trail Edge of the Seam Hole to the Lead Edge of the Seam Zone; Units = mm.
BeltSeamZoneLengthPitch = Length of Seam Zone along the IT Belt; Units = mm.
BeltVirtualSeamHoleOffsetLength = Length for debounce of the Seam Hole Signal which occurs in the Belt Control Board; Units = mm.
PEGImageShiftTotal = Amount of shift in the Image to avoid IT Belt Edge Ghosting, Stored in NVM. Units = mm.
RegSync1LeadEdge_256RMC = ROUND ((TESeamHoleDB_To_LEImagePanel1)/ ROSMasterClockResolution * 1000 * BeltEnc_ScalingFactor) + BeltHomeSensor2ToRegSyncOffset
Where:
RegSync1LeadEdge_256RMC = The number of 256ROSMasterClock blocks to count relative to Trail Edge of the Seam Hole from BHS #2 in order to generate the Lead Edge of Reg Sync for Image Panel 1; Units = 256ROSMasterClocks. The value is rounded to the nearest integer 256ROSMasterClock.
BeltHomeSensor2ToRegSyncOffset = Distance traveled along IT Belt from BHS2 to the location where the Reg Sync Signal is generated. Units = mm.
ROSMasterClockResolution = Distance along the IT Belt for one block of 256 ROS Master Clocks at the nominal IT Belt speed.
BeltEnc_ScalingFactor = Percent difference of actual encoder frequency from nominal encoder frequency. BeltEnc_ScalingFactor = 1 for Cayman.
The RegSync1LeadEdge_256RMC value is calculated by Apps SW and downloaded to the FPGA residing on the MIOP Board.
The Apps SW calculates the number of 256 ROS Master Clock blocks from Image Lead Edge to the next Image Lead Edge. This value is downloaded to the MIOP FPGA.
The number of potential images transferred to the photoreceptor for a complete belt rev (Pitch Mode) is used to determine the number of Reg Sync Signals generated for a given belt rev. This value is downloaded to the MIOP FPGA.
This value is calculated by Apps SW and downloaded to the FPGA residing on the MIOP Board in a register called PITCH.
The PITCH value is the nearest integer number of images transferred to the IT Belt during a complete revolution.

---

Reg Sync Fine Correction

---

The MIOP FPGA counts the number of single ROS Master Clocks (NOT blocks of 256 ROS Master Clocks) from the BHS#1 trigger until the next count of ROS Master Clock Blocks (256 RMC), BHS1_To_RMCBlock.
The MIOP FPGA counts the number of single ROS Master Clocks (NOT blocks of 256 ROS Master Clocks) from the BHS#2 trigger until the next count of ROS Master Clock Blocks (256 RMC), BHS2_To_RMCBlock.

-continued

---

The MIOP FPGA calculates the difference between the number of single ROS Master Clocks from each BHS to the first Block of 256 ROS Master Clocks for the corresponding belt hole signals for a given belt rev:
DeltaBHS1_To_BHS2 = 256 + (BHS1_To_RMCBlock − BHS2_To_RMCBlock)
Note: This value is in units of single ROS Master Clock counts
The MIOP FPGA counts RegSync1LeadEdge_256RMC Blocks of 256 ROS Master Clocks and then add DeltaBHS1_ToBHS2 single ROS Master Clocks in order to generate the Lead Edge of the first Reg Sync for each Belt Rev:
RegSync1LeadEdge = [RegSync1LeadEdge_256RMC − 1] + DeltaBHS1_To_BHS2
Note: This part of this equation in brackets is in units of 256 ROS Master Clock counts, and the other part is in units of single ROS Master Clock counts.
The MIOP FPGA counts Blocks of 256 ROS Master Clocks and then add DeltaBHS1_ToBHS2 single ROS Master Clocks in order to generate the Trail Edge of the first Reg Sync for each Belt Rev:
RegSync1TrailEdge = [RegSync1LeadEdge_256RMC + RegSyncLength_256RMC − 1] + DeltaBHS1_To_BHS2
Where:
RegSyncLength_256RMC = The number of 256 ROS Master Clock blocks representing the duration of the Reg Sync Signal.
Note: This part of this equation in brackets is in units of 256 ROS Master Clock counts, and the other part is in units of single ROS Master Clock counts.
The MIOP FPGA counts Blocks of 256 ROS Master Clocks and then add DeltaBHS1_To_BHS2 single ROS Master Clocks in order to generate subsequent Reg Sync transitions for each Belt Rev, up to Pitch number of Reg Syncs:
RegSyncXLeadEdge = [RegSync1LeadEdge_256RMC − 1 + Image_To_Image * X] + DeltaBHS1_To_BHS2
RegSyncXTrailEdge = [RegSync1LeadEdge_256RMC − 1 + Image_To_Image * X + RegSyncLength_256RMC] + DeltaBHS1_To_BHS2
Where:
X = 1 to Pitch − 1
Note: This part of this equation in brackets is in units of 256 ROS Master Clock counts, and the other part is in units of single ROS Master Clock counts.

---

Referring to FIG. 2, the printing machine of an exemplary embodiment uses a charge retentive surface in the form of an Active Matrix (AMAT) photoreceptor belt 10 supported for movement in the direction indicated by arrow 12, for advancing sequentially through various xerographic process stations. The belt is entrained about a drive roller 14, tension roller 16 and fixed rollers 18, and the drive roller 14 is operatively connected to a drive motor 20 for effecting movement of belt 11 through the xerographic process stations. Belt 10 has a seam that corresponds to a seam hole in the belt. In proximity to belt 10 is are seam hole sensors 11 and 9 that detect the passage of the seam hole as belt 10 moves in the direction indicated by arrow 12, and provides a seam hole signal 13 and 14, respectively, to control system 90.

A portion of belt 10 corresponding to an image area passes through charging station A where a corona generating device 22 charges the photoconductive surface of belt 10 to a relatively high, substantially uniform, preferably negative potential.

Next, the charged portion of belt 10 is advanced through an imaging/exposure station B. At imaging/exposure station B, control system 90 receives the image signals from controller 100 representing the desired output image, and processes these signals to convert them to the various color separations of the image which is transmitted to a laser based output scanning device 24 (imaging device 24), which causes the charged portion of belt 10 to be discharged in accordance with the output from the scanning device. Preferably scanning device 24 is a laser Raster Output Scanner (ROS) having a driving motor. Alternatively, the ROS could be replaced by other imaging devices and xerographic exposure devices such as LED arrays.

The charged portion of belt 10, which is initially charged to a voltage Vo, undergoes dark decay to a level Vddp equal to about −500 volts. When exposed at the exposure station B it is discharged to Vexpose equal to about −50 volts. Thus, after exposure, the charged portion of belt 10 contains a monopolar voltage profile of high and low voltages, the former corresponding to charged or background areas and the latter corresponding to discharged areas.

At a first development station C, developer structure 32, utilizing a hybrid scavengeless development (HSD) system, includes a development roll, better known as the donor roll, that is powered by two development fields (potentials across an air gap). The first development field is the AC jumping field that is used for toner cloud generation. The second development field is the DC development field that is used to control the amount of developed toner mass on belt 10. The toner cloud causes charged toner particles 26 to be attracted to the electrostatic latent image in the discharged portion of belt 10. Appropriate developer biasing is accomplished via a power supply. This type of system is a noncontact type in which only toner particles (black, for example) are attracted to the latent image and there is no mechanical contact between belt 10 and a toner delivery device to disturb a previously developed, but unfixed, image on the charged portion of belt 10.

The developed but unfixed image is then transported past a second charging device 36 where the charged portion of belt 10 is recharged to a predetermined level.

A second exposure/imaging is performed by imaging device 24 for station C which comprises a laser based output structure that is utilized for selectively discharging the charged portion of belt 10 on toned areas anchor bare areas, pursuant to the image to be developed with a second color toner. At this point, the charged portion of belt 10 contains toned and untoned areas at relatively high voltage levels and toned and untoned areas at relatively low voltage levels. These low voltage areas represent image areas that are developed using discharged area development (DAD). To this end, a negatively charged developer material 40 including color toner is employed. The toner, which by way of example may be yellow, is contained in developer structure 42 disposed at a second development station D and is presented to the latent images on the discharged portion of belt 10 by way of a second HSD system. A power supply (not shown) serves to electrically bias the developer structure to a level effective to develop the discharged image areas with negatively charged yellow toner particles 40.

The above procedure is repeated for a third image for a third suitable color toner such as magenta and for a fourth image and suitable color toner such as cyan at stations E and F, respectively. The exposure control scheme described below may be utilized for these subsequent imaging steps. In this manner a full color composite toner image is developed on the photoreceptor belt. The timing of the various imaging stations is sensed and controlled by the system as described below.

To the extent to which some toner charge is totally neutralized, or the polarity reversed, thereby causing the composite image developed on belt 10 to consist of both positive and negative toner, a negative pre-transfer dicorotron member 50 is provided to condition the toner for effective transfer to a substrate using positive corona discharge.

Subsequent to image development, a sheet of support material 52 is moved into contact with the toner images at transfer station G. Sheet 52 is advanced to transfer station C by the sheet feeding apparatus 200. Sheet 52 is then brought into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from belt 10 to sheet 52. A detack dicorotron 56 is provided for facilitating stripping of the sheets from belt 10.

After transfer, sheet 52 continues to move, in the direction of arrow 58, onto a conveyor which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 5 passes between fuser roller 62 and backup roller 64 with the toner powder image contacting fuser roller 62. In this manner, the toner powder images are permanently affixed to sheet 52. After fusing, a chute (not shown) guides the advancing sheets 52 to a catch tray, stacker, finisher or other output device (not shown), for subsequent removal from the printing machine by the operator.

After the sheet of support material is separated from photoconductive surface of belt 10, the residual toner partides carried by the non-image areas on the photoconductive surface are removed therefrom. These particles are removed at cleaning station I using a cleaning brush or plural brush structure contained in a housing 66.

It is believed that the foregoing description is sufficient for the purposes of the present application to illustrate the general operation of a color printing machine.

As described above, image-on-image (101) single-pass xerographic systems are designed such that different colors are laid on top of each other all in one pass of photoreceptor belt 10. In order for this to happen, each color has its own image station that includes a charging device, a raster output scanner (ROS) or scanning and/or imaging device (that controls how the latent image is formed on the photoreceptor belt), a developer (that applies the colored toner to the latent image on the belt), and a belt hole sensor or controller that signals the imaging device to begin forming the image. Therefore, if an 101 single-pass system applies four colors, there will be four image stations, each consisting of a charge device, scanning and/or imaging device, developer and one or more belt hole sensors.

As stated above, the imaging device of each image station needs a timing signal to initiate the formation of the latent image at the right time for its respective color. Previously, this signal has been related to a series of fixed holes on the edge of the photoreceptor belt. As each belt hole approaches an image station, a belt hole sensor for that image station provides a signal to a controller that, in turn, provides an image initiation signal to cause the imaging device to begin forming the latent image on the belt in accordance with an image position established by the location of the belt hole. For ten pitch operation, there would be ten holes on the belt. The first hole would be larger than the others to signify the location of the seam on the belt. Such a system, however, does not allow the pitch of the belt to be changed.

Existing virtual belt hole systems use only the first belt hole in the belt to indicate the location of the belt seam, and thus do not require the presence of additional belt holes. Instead, existing virtual belt hole systems use the position of the first belt hole and the distance the belt moved after detection of the first belt hole, provided by an encoder, to provide coordinated signals though a controller that cause the imaging stations to initiate formation of latent images on the belt. Such systems allow the pitch of a belt to be varied, for example, based on the size of the copy sheets. However, as mentioned above, the image initiation signal based on the signal provided by the belt hole detector is not synchronized with a clock signal that controls the imaging stations. This non-synchronous system thus introduces a delay between the point when the controller provides the image initiation signal to an imaging station and the point when that imaging station detects the next clock count after receipt of the image initiation signal and executes the imaging process triggered by the image initiation signal. During this delay, the belt moves a certain distance and causes the formation of the image to be off slightly by at least the magnitude of the delay, resulting in reduction of image quality.

To minimize the effect of the delay, some 101 single-pass systems speed up and slow down (rephase) the motor for each imaging station to make the imaging stations individually approach synchronization with the each station's image initiation signal. Such changes to imaging station motor speed require significant time during which images are positionally unstable, impacting the minimum size of inter-document zones (inter-image areas), and reducing the efficiency of the xerographic system. At faster belt velocities, the rephase time equates to larger belt travel distances that require larger inter-image areas, and that further reduce the efficiency of the xerographic system.

To address the aforementioned problems with previous virtual belt hole systems, the present xerographic system uses the position of the first belt hole, detected by a belt hole sensor, and an elapsed time after the detection of the first belt hole, provided as a clock count from a timer or Master Clock, to control the location of images by all of the image stations on a photoreceptor belt. Because the clock counts provided by the Master Clock are used to determine when to initiate the imaging device of each image station, the control signal (the Master Clock signal) is synchronous for all the image stations, and thus no delay is required to compensate for asynchronicity between the initiation signal and the clock signal, as seen with the previous virtual hole systems.

Figure 3:
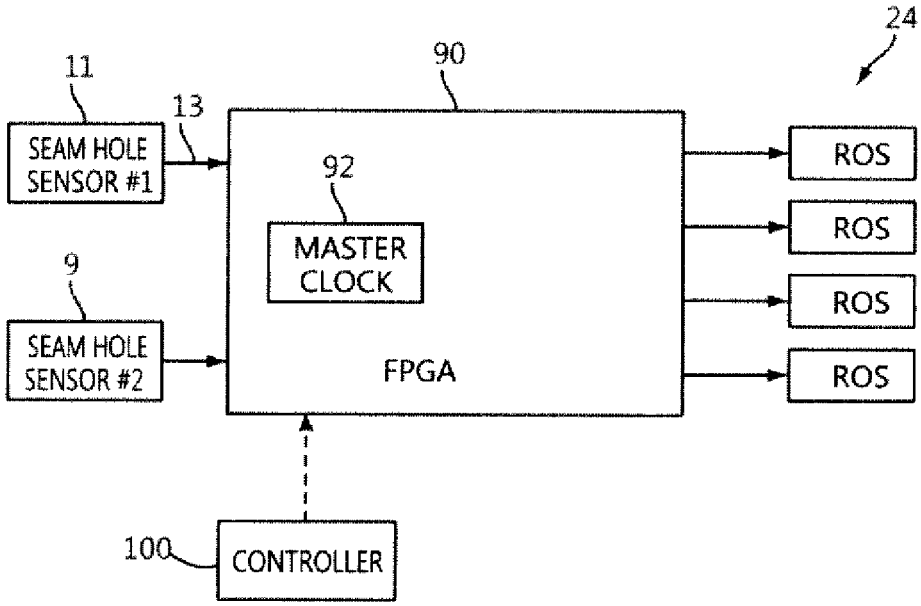
FIG. 3 is a block diagram of a control system according to an exemplary embodiment of this disclosure; and, FIG. 4 is a timing diagram of a control system according to an exemplary embodiment of this disclosure.

Referring to FIG. 3, the control system 90 of the exemplary embodiment includes a Master Clock 92 that provides a clock signal, or clock counts, to the controller 100 and to the imaging devices 24 of each image station. The Master Clock 92 can also be provided external to the control system 90. The control system 90 is also provided with a signal 82 from the encoder 80, a seam hole signal 13 from the seam hole sensor 11, and a signal from the controller 100, as explained above for FIG. 2. As also explained above, the seam hole sensor 11 provides the seam hole signal 13 when the seam hole in the photoreceptor belt 10 is detected. After being provided with the seam hole signal 13, the controller 94 establishes the next clock count, or a suitable subsequent clock count, output by Master Clock 92, as a reference point corresponding to the location of the seam of the photoreceptor belt 10. The controller 94 then waits for a specified number of clock counts until providing an image initiation signal for a particular color component image of a particular multi-color image to the imaging device 24 of the appropriate image station, and the signaled imaging device then initiates an image forming process. This process is repeated for the remaining imaging stations for the appropriate number of images until the belt hole sensor again identifies the location of the belt seam and reestablishes the reference point for use with the next cycle of the belt. (For example, if the belt has a pitch of five, and the print job has five or more multi-color images, each image station would be 40 initiated five times during one cycle of the belt to form 5 IOI toner images.) Each of the image initiation signals provided by control system 90 is based on the clock counts provided by Master Clock 92 and thus each is synchronous with control signals provided to the imaging devices 24, which operate in accordance with the same clock counts provided by master Clock 92. Accordingly, there is no delay between the image initiation signal and the next clock count of the imaging devices, as experienced with prior systems.

The control system 90 includes a microprocessor that is programmed with firmware, however, it is also possible to perform the same function with a software application. The board assembly also has hardware to read inputs into the microprocessor and hardware to allow the microprocessor to produce outputs. The Master Clock 92 also provides a signal 55 to other time-dependent xerographic systems requiring a clock signal. Another input to the control system 90 is signal 82 provided by encoder 80 for encoder feedback. Encoder 80 is attached to a roller on photoreceptor belt 10 and signal 82 is used for motion control algorithms. Based on the encoder output, the speed of photoreceptor 10 is precisely controlled and maintained substantially constant.

Figure 4:
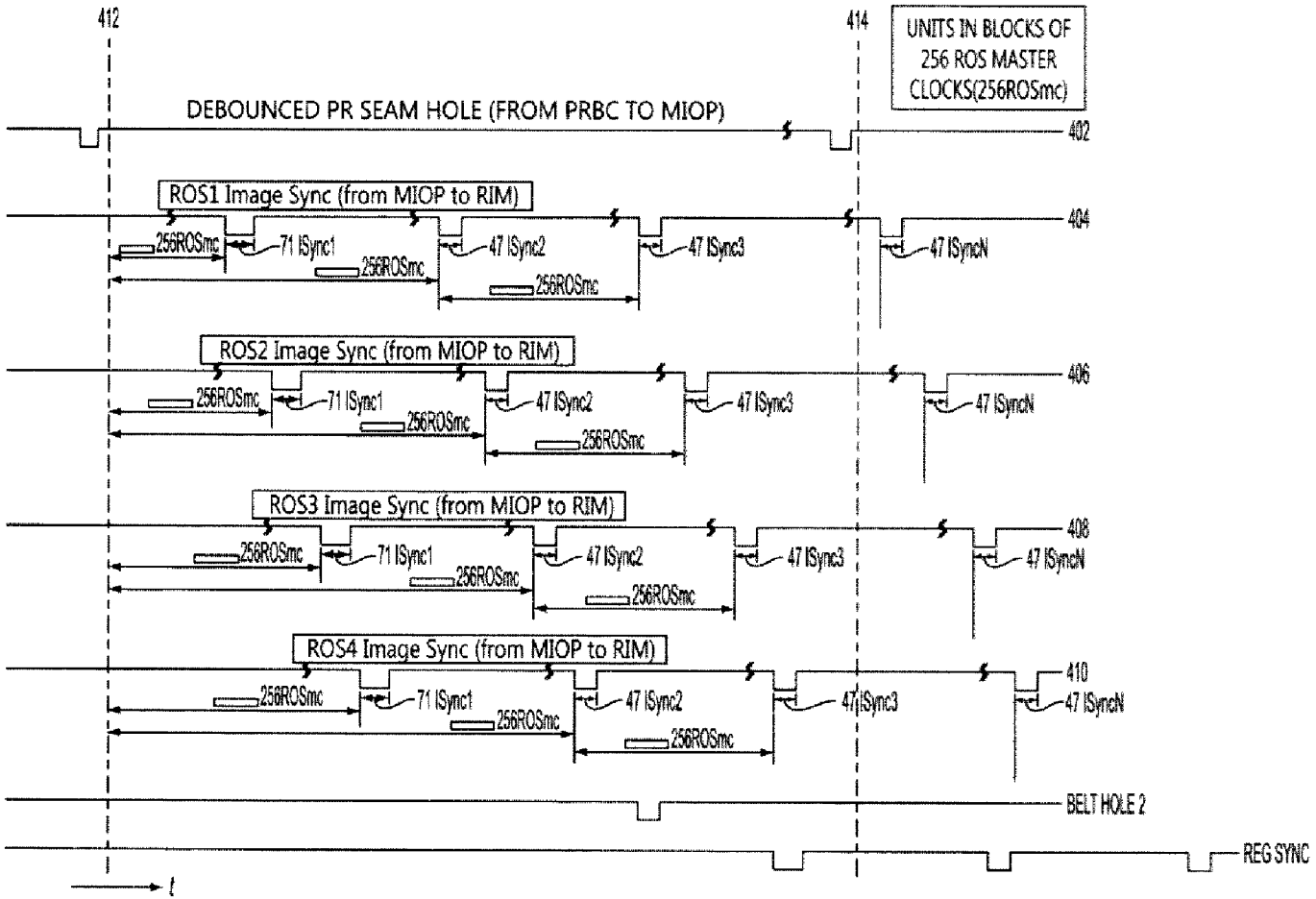

FIG. 4 represents the operation of control system 90 over time t corresponding to the clock count provided by Master Clock 92. The control system 90, according to this embodiment, is a FPGA—Field Programmable Gate Array. Line 402 corresponds to the seam hole signal 13 provided to control system 90 by seam hole sensor 11. After receiving the seam hole signal 13, indicated by a change in line 402, controller 94 sets a subsequent clock count as a reference point, indicated by vertical dotted lines. In the representation provided in FIG. 4, first reference point 412 is provided after the first change in line 402 and a second reference point 414 is provided after the second change in line 402. Reference points 412 and 414 mark the beginnings of respective cycles of the photoreceptor belt 10.

After controller 94 sets first reference point 412, the Master Clock 92 continues to provide clock counts to controller 94 and to each ROS 24, represented by lines 404, 406, 408, and 410. As the speed of photoreceptor belt 11 is nearly constant, each clock count relates to a certain distance traveled by photoreceptor belt 10. Controller 100 provides layout data to control system 90 indicating the spacing to be implemented by control system 90 when providing image initiation signals to each ROS 24. The layout data can be distances required to form image areas on photoreceptor belt 10 and distances required between each adjacent image area on belt 10, and control system 90 can convert the distances to a corresponding clock count. The layout data can also be provided to control system 90 as a value that is a time, or as a clock count that does not require conversion.

The layout data corresponds to the number of clock counts required before control system 90 provides an image initiation signal to each ROS 24. As shown in FIG. 4, for line 404, an image initiation signal is provided by controller 94 to a first ROS 24, identified as ROS1, at a clock count based on first reference point 412 and identified as ISinc1, which lasts for 71 clock counts. Another subsequent image initiation signal Isinc2 is provided again to ROS1 at a clock count based on first reference point 412, and again for Isync 3. Similarly arranged image initiation signals are provided, based on different clock counts, for each of lines 406, 408 and 410. FIG. 4 thus corresponds to a photoreceptor belt having a pitch of three because three image initiation signals are provided for a single cycle of belt 10 between reference points 412 and 414.

Variations in the timing or recognition of the seam hole signal 13 are eliminated because the seam hole signal is made to correspond to a reference point that is a clock count of Master Clock 92. For each image initiation signal represented in FIG. 4, the image initiation signal provided to each ROS 24 is synchronous with the Master Clock 92 because each is based on reference point 412 and a specified number of clock counts from the Master Clock. Accordingly, the operation of each ROS is synchronous to the seam hole signal, and there is no delay requiring alteration to the operation of any ROS.

Furthermore, the operation of the electrophotographic printing machines using the exemplary control system and method are not limited by the time required to adjust the operation of a ROS, permitting faster and more efficient operation. The exemplary system and method also allow a more accurate and efficient placement and detection of chevrons on belt 10.

The exemplary embodiment is also designed to require as few download parameters as possible when determining the layout data to be used by control system 90. The following table lists parameters that can be downloaded as layout data to an exemplary embodiment of control system 90 having a pitch of 10, i.e., 10 image areas for each cycle of photoreceptor belt 10. By using the parameters described in TABLE 1, the timing of the image initiation signals relative to the seam hole (set to correspond to a reference point based on a clock count) can be calculated.

TABLE 1

Parameter Downloads Used to Generate ROS Master Clock Image Sync and Reg Sync Signals

| Parameter for Image Sync and Reg Sync Generation | Layout Value (mm) | Clock Count Value (256 ROS MC) Comments | Comments |
|---|---|---|---|
| Constant Parameters | | | |
| SeamSensor_To_ROS1 | −46.8000 | −553.0 | |
| Seam_Hole_Length | 6.0000 | 71.0 | =PRBeltSeamHoleLength = 6 mm |
| Belt_Hole_Length | 4.000 | 47.0 | =6.0 − 2.0 |
| Variable Parameters (at Cycle Up) | | | |
| PREnc_ScalingFactor | | 1.00097 | =3111/ NVM4652_prBeltModEncoderRewq |
| ROS_To_ROS_UnitDistance | 308.0470 | 3642.0 | ROS2 To ROS3 and ROS3 To ROS4 = ROUND(308.047/(84.6667/1000) * PREnc_ScalingFactor, 0) |
| ROS1_to_ROS2_Distance | 616.0940 | 7284.0 | =ROUND(308.047 * 2/ (84.6667/1000) * PREnc_ScalingFactor, 0) |
| Variable Parameters (with Print Mode Change) | | | |
| TESeamHoleDB_To_LEImageSync1 | 331.8000 | 3923.0 | =347.60 + PRBeltSeamZoneLengthPitch# − PRBeltRephaseDistancePitch# − 8.0 − 7.0 − 6.0+ |
| TESeamHoleDB_To_LEImageSync2 | 743.5000 | 8790.0 | +347.60 + PRBeltSeamZoneLengthPitch# + 36.40 + Pitch#MaximageLength − 8.0 − 7.0 − 4.0+ NVM21965_PEGImageShiftTotalmm |
| Image_To_Image | 265.9000 | 3144.00 | =Pitch#MaximageLength + 32.40 |
| Image_Per_Rev | 10 | | +Pitch#MaximageLength + 32.40 |

The above parameters can be downloaded to the controller prior to the detection of a seam. All values are buffered since different imaging/exposure stations will often be working on different belt revolutions. Newly downloaded pitch information will take place on the next belt revolution for each imaging/exposure station regardless of when the information is received.

As shown in Table 1 and FIG. 4, the speed of the Master Clock may be different from the speed of the ROS, thus requiring the use of a scaling factor of 256, for example. Another scaling factor may also be applied to the Master Clock signal, a ROS signal, or to the image initiation signal to account for variations in average photoreceptor belt velocities.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of registering a transfer of an image from a belt to a media substrate associated with a printing device, the printing device including an image transfer belt operatively coupled to one or more primary image transfer devices configured to transfer an image to the image transfer belt, an image transfer point configured to transfer an image from the image transfer belt to the media substrate, an image transfer belt location target fixed to the image transfer belt, a first belt location sensor operatively connected to a controller for timing the transfer of images from the primary image transfer devices to the image transfer belt, a second belt location sensor located downstream of a belt tensioning device and upstream of the image transfer point, the second belt location sensor operatively connected to the controller for timing the transfer of an image from the image transfer belt to the media substrate at the image transfer point, and a master clock operatively connected to the controller for timing the transfer of an image to the image transfer belt and the transfer of an image from the image transfer belt to the media substrate, the method comprising:

a) detecting the presence of the belt location target by the first belt location sensor and initiating the counting of master clock counts;

b) transferring an image to the image transfer belt from one or more of the primary image transfer devices after a first predetermined number of master clock counts;

c) detecting the presence of the belt location target by the second belt location sensor; and d) transferring the image from the image transfer belt to a media substrate after a second predetermined number of master clock counts whereby the second predetermined number of master clock counts corresponds to the time required for the image transfer belt to travel the distance from the second belt location sensor to the image transfer point.

2. The method according to claim 1, wherein the first and second predetermined number of master clock counts are in blocks of single master clock counts.

3. The method according to claim 2, comprising:

counting a first number of single master clock counts within a block, before counting an initial master clock count block associated with the presence of the belt location target by the first belt location sensor in step a); and transferring the image from the image transfer belt to the media substrate after the second predetermined number of master clock block counts plus the first number of single master clock counts.

4. The method according to claim 3, wherein transferring the image from the image transfer belt to a media substrate after a second predetermined number of master clock counts whereby the second predetermined number of master clock counts corresponds to the time required for the image transfer belt to travel the distance from the second belt location sensor to the image transfer point comprising:

counting a second number of single master clock counts within a block, before counting the initial master clock count block associated with the presence of the belt location target by the second belt location sensor in step c); and transferring the image from the image transfer belt to the media substrate after the second predetermined number of master clock block counts plus an offset number of single master clock counts, whereby the second predetermined number of master clock block counts and offset number at single master clock counts account for the first number of single master clock counts and the second number of single master clock counts.

5. The method according to claim 1, wherein the master clock is operatively connected to a FPGA (Field Programmable Gate Array), the FPGA is operatively connected to a RIM (ROS Interface Module) and the RIM is operatively connected to one or more ROSs associated with the one or more primary image transfer devices, and the method comprises:

the RIM generating Isync signals to the one or more ROSs in step b); and the FPGA generating a reg sync signal in step d) to transfer the image from the image transfer belt to the media substrate.

6. The method according to claim 1, wherein the master clock is a ROS master clock and the master clock counts are associated with ROS master clock counts.

7. A computer program product, storing instructions that when executed by a computer, cause the computer to perform a method of registering a transfer of an image from a belt to a media substrate associated with a printing device, the printing device including an image transfer belt operatively coupled to one or more primary image transfer devices configured to transfer an image to the image transfer belt, an image transfer point configured to transfer an image from the image transfer belt to the media substrate, an image transfer belt location target fixed to the image transfer belt, a first belt location sensor operatively connected to a controller for timing the transfer of images from the primary image transfer devices to the image transfer belt, a second belt location sensor located downstream of a belt tensioning device and upstream of the image transfer point, the second belt location sensor operatively connected to the controller for timing the transfer of an image from the image transfer belt to the media substrate at the image transfer point, and a master clock operatively connected to the controller for timing the transfer of an image to the image transfer belt and the transfer of an image from the image transfer belt to the media substrate, the method comprising:

a) detecting the presence of the belt location target by the first belt location sensor and initiating the counting of master clock counts;

b) transferring an image to the image transfer belt from one or more of the primary image transfer devices after a first predetermined number of master clock counts;

c) detecting the presence of the belt location target by the second belt location sensor; and d) transferring the image from the image transfer belt to a media substrate after a second predetermined number of master clock counts whereby the second predetermined number of master clock counts corresponds to the time required for the image transfer belt to travel the distance from the second belt location sensor to the image transfer point.

8. The computer program product according to claim 7, wherein the first and second predetermined number of master clock counts are in blocks of single master clock counts.

9. The computer program produce according to claim 8, comprising:

counting a first number of single master clock counts within a block, before counting an initial master clock count block associated with the presence of the belt location target by the first belt location sensor in step a); and transferring the image from the image transfer belt to the media substrate after the second predetermined number of master clock block counts plus the first number of single master clock counts.

10. The computer program product according to claim 9, wherein transferring the image from the image transfer belt to a media substrate after a second predetermined number of master clock counts whereby the second predetermined number of master clock counts corresponds to the time required for the image transfer belt to travel the distance from the second belt location sensor to the image transfer point comprising:

counting a second number of single master clock counts within a block, before counting the initial master clock count block associated with the presence of the belt location target by the second belt location sensor in step c); and transferring the image from the image transfer belt to the media substrate after the second predetermined number of master clock block counts plus an offset number of single master clock counts, whereby the second predetermined number of master clock block counts and offset number at single master clock counts account for the first number of single master clock counts and the second number of single master clock counts.

11. The computer program product according to claim 7, wherein the master clock is operatively connected to a FPGA (Field Programmable Gate Array), the FPGA is operatively connected to a RIM (ROS Interface Module) and the RIM is operatively connected to one or more ROSs associated with the one or more primary image transfer devices, and the method comprises:

the RIM generating Isync signals to the one or more ROSs in step b); and the FPGA generating a reg sync signal in step d) to transfer the image from the image transfer belt to the media substrate.

12. The computer program product according to claim 7, wherein the master clock is a ROS master clock and the master clock counts are associated with ROS master clock counts.

13. A printing apparatus comprising:

an image transfer belt including a belt tensioning device;

one or more primary image transfer devices configured to transfer an image to the image transfer belt;

an image transfer point adapted to transfer an image from the image transfer belt to a media substrate;

a target fixed to the image transfer belt to determine the location of the image transfer belt;

a first belt location sensor located upstream of the one or more primary image transfer devices;

a second belt location sensor located downstream of the belt tensioning device and upstream of the image transfer point;

a ROS master clock; and a controller, the controller configured to execute the method comprising:

a) detecting the presence of the belt location target by the first belt location sensor and initiating the counting of ROS master clock counts;

b) transferring an image to the image transfer belt from one or more of the primary image transfer devices after a first predetermined number of ROS master clock counts;

c) detecting the presence of the belt location target by the second belt location sensor; and d) transferring the image from the image transfer belt to a media substrate after a second predetermined number of ROS master clock counts whereby the second predetermined number of ROS master clock counts corresponds to the time required for the image transfer belt to travel the distance from the second belt location sensor to the image transfer point.

14. The printing apparatus according to claim 13, wherein the first and second predetermined number of ROS master clock counts are in blocks of 256 single ROS master clock counts.

15. The printing apparatus according to claim 14, comprising:

counting a first number of single ROS master clock counts within a block, before counting an initial ROS master clock count block associated with the presence of the belt location target by the first belt location sensor in step a); and transferring the image from the image transfer belt to the media substrate after the second predetermined number of ROS master clock block counts plus the first number of single ROS master clock counts.

16. The printing apparatus according to claim 15, wherein transferring the image from the image transfer belt to a media substrate after a second predetermined number of ROS master clock counts whereby the second predetermined number of ROS master clock counts corresponds to the time required for the image transfer belt to travel the distance from the second belt location sensor to the image transfer point comprising:

counting a second number of single ROS master clock counts within a block, before counting the initial ROS master clock count block associated with the presence of the belt location target by the second belt location sensor in step c); and transferring the image from the image transfer belt to the media substrate after the second predetermined number of ROS master clock block counts plus an offset number of single ROS master clock counts, whereby the second predetermined number of ROS master clock block counts and offset number at single ROS master clock counts account for the first number of single ROS master clock counts and the second number of single ROS master clock counts.

17. The printing apparatus according to claim 13, wherein the ROS master clock is operatively connected to a FPGA (Field Programmable Gate Array), the FPGA is operatively connected to a RIM (ROS Interface Module) and the RIM is operatively connected to one or more ROSs associated with the one or more primary image transfer devices, and the method comprises:

the RIM generating Isync signals to the one or more ROSs in step b); and the FPGA generating a reg sync signal in step d) to transfer the image from the image transfer belt to the media substrate.

18. The printing apparatus according to claim 13, wherein the one or more primary image transfer devices are PR (photo receptor) drums.

19. The printing apparatus according to claim 13, wherein the image transfer belt is a PR belt.

20. The printing apparatus according to claim 13, wherein the target fixed to the image transfer belt has one or more seam holes associated with the image transfer belt.

21. The printing apparatus according to claim 13, wherein the belt tensioning device is located downstream of the one or more primary mage transfer devices.

* * * * *